US011501665B2

(12) United States Patent
Tiainen et al.

(10) Patent No.: US 11,501,665 B2
(45) Date of Patent: Nov. 15, 2022

(54) LABEL ARRANGEMENT FOR A FOOD PACKAGE

(71) Applicant: UPM Raflatac Oy, Tampere (FI)

(72) Inventors: Marko Tiainen, Jyväskylä (FI); Marzena Sidelnik-Paterewicz, Wroclaw (PL)

(73) Assignee: UPM RAFLATAC OY, Tampere (FI)

( * ) Notice: Subject to any disclaimer, the term of this patent is extended or adjusted under 35 U.S.C. 154(b) by 0 days.

(21) Appl. No.: 16/980,928

(22) PCT Filed: Mar. 19, 2019

(86) PCT No.: PCT/FI2019/050230
§ 371 (c)(1),
(2) Date: Sep. 15, 2020

(87) PCT Pub. No.: WO2019/180320
PCT Pub. Date: Sep. 26, 2019

(65) Prior Publication Data

US 2020/0410904 A1 Dec. 31, 2020

Related U.S. Application Data

(60) Provisional application No. 62/644,677, filed on Mar. 19, 2018.

(51) Int. Cl.
*G09F 3/10* (2006.01)
*B65D 75/52* (2006.01)
(Continued)

(52) U.S. Cl.
CPC ..... *G09F 3/10* (2013.01); *B65D 75/522* (2013.01); *B65D 77/003* (2013.01);
(Continued)

(58) Field of Classification Search
CPC ..... G09F 2003/0251; B65D 75/522
(Continued)

(56) References Cited

U.S. PATENT DOCUMENTS 2,012,483 A 8/1935 Schlegel
2,527,313 A 10/1950 Kohl
(Continued)

FOREIGN PATENT DOCUMENTS

CN 101107638 A 1/2008
GB 2156767 A 10/1985
(Continued)

OTHER PUBLICATIONS

International Preliminary Report on Patentability for the corresponding International Application No. PCT/FI2019/050230, International Filing Date: Mar. 19, 2019, dated May 8, 2020; 20 pages.
(Continued)

*Primary Examiner* — Gary C Hoge
(74) *Attorney, Agent, or Firm* — Cantor Colburn LLP

(57) ABSTRACT

This invention relates to a label arrangement for consumer destined food packages. A food package (10, 50) comprises at least an undertray (20) and a lidstock (40) arranged together defining in between a cavity for a food product (30). The label arrangement according to the invention comprises a printable face material (110) and a pressure sensitive adhesive (120) for attachment of the label (100) onto the package (10, 50). The adhesive surface of the pressure sensitive adhesive (120) layer is arranged to have one or more adhesion free (550) and printed zones and the label (100) is further arranged with one or more weakenings (700) through the label face material (110) allowing to manually fold the part of the label with adhesion free (550) and printed zone for visual inspection of said printing while the label (100) otherwise remains attached to the package (10, 50).
(Continued)

The label (100) is arranged onto the package (10, 50) so that said manual folding of the part of the label with the adhesion free (550) and printed zone increases visual access to food product (30) in the package (10, 50).

33 Claims, 7 Drawing Sheets

(51) Int. Cl.

| | |
|---|---|
| ***B65D 77/00*** | (2006.01) |
| ***B65D 81/20*** | (2006.01) |
| ***G09F 3/04*** | (2006.01) |
| *G09F 3/02* | (2006.01) |

(52) U.S. Cl.
CPC ..... *B65D 81/203* (2013.01); *G09F 3/04* (2013.01); *B65D 2203/02* (2013.01); *G09F 2003/0251* (2013.01)

(58) Field of Classification Search
USPC ..... 40/637
See application file for complete search history.

(56) References Cited

U.S. PATENT DOCUMENTS

| | | | | |
|---|---|---|---|---|
| 5,088,617 | A | 2/1992 | Williams et al. | |
| 5,645,300 | A * | 7/1997 | Hill | B65D 75/54 283/101 |
| 5,704,649 | A * | 1/1998 | Small | B65D 55/06 283/101 |
| 6,394,337 | B1 | 5/2002 | Ross et al. | |
| 6,770,345 | B2 * | 8/2004 | Sellars | G09F 3/0289 283/81 |
| 2002/0130093 | A1 | 9/2002 | Ferrara, Jr. et al. | |
| 2003/0098343 | A1 | 5/2003 | Ross | |
| 2006/0285780 | A1 | 12/2006 | Knoerzer et al. | |
| 2010/0104701 | A1 * | 4/2010 | Ibe | A23B 4/16 426/129 |
| 2011/0086194 | A1 * | 4/2011 | Williams | G09F 3/10 428/43 |
| 2013/0279832 | A1 | 10/2013 | Burri et al. | |
| 2014/0116904 | A1 | 5/2014 | Fosbury et al. | |
| 2015/0034509 | A1 | 2/2015 | Seyfferth De Oliveira | |
| 2015/0314938 | A1 | 11/2015 | Bomba et al. | |
| 2016/0180747 | A1 | 6/2016 | Pietarinen et al. | |
| 2017/0096272 | A1 | 4/2017 | Coon et al. | |
| 2017/0283139 | A1 | 10/2017 | Fosse | |
| 2017/0369222 | A1 | 12/2017 | Berger et al. | |

FOREIGN PATENT DOCUMENTS

| | | |
|---|---|---|
| GB | 2306150 | 4/1997 |
| JP | 2003237832 A | 8/2003 |
| WO | 2006058955 A1 | 6/2006 |
| WO | 2011158014 A1 | 12/2011 |
| WO | 2014026334 A1 | 2/2014 |

OTHER PUBLICATIONS

Written Opinion for the corresponding International Application No. PCT/FI2019/050230, International Filing Date: Mar. 19, 2019; 8 pages.

International Search Report for the corresponding PCT/FI2019/050230, International Filing date: Mar. 19, 2020; dated Jun. 4, 2019; 4 pages.

He Xiaodan, "The form of packaging anti-counterfeiting", China Academic Journal Electronic Publishing House; 4 pages with English machine translation.

* cited by examiner

"D"

"C"

"C"

"L"

LABEL ARRANGEMENT FOR A FOOD PACKAGE

CROSS-REFERENCE TO RELATED APPLICATIONS

This application is a National Stage application of PCT/FI2019/050230, filed Mar. 19, 2020, which claims benefit of U.S. Application No. 62/644,677 filed on Mar. 19, 2018, both of which are incorporated by reference herein in their entirety.

TECHNICAL FIELD

This invention relates to labels for consumer destined food packages. Such food packages or containers may be, for example, formed via lamination or by closing a box or a tray type container with a lid.

BACKGROUND

Food products such as meat, sausages, hams, cheeses, fish, vegetables, fruits, salads etc. are packaged in different type of trays with lidstock covers. These packages may be vacuum packages where two, typically plastic sheets have been laminated together with food product contained in between the lid and bottom sheet type undertray and the package having a thin overall structure. Alternatively, the packages may be formed from deeper recessed pre-made undertrays or boxes made from various thermoplastic materials and closed by laminated lidstock. These packages may be modified atmospheric packages (MAP), where the food is contained in special gaseous atmosphere preserving the freshness by slowing down the growth of aerobic organisms and preventing oxidation reactions. The food packages can be formed from various plastic materials as well as from other materials such as bio-based or fiber-based materials treated with coating and/or barrier layers to make them suitable as food containers. The packages, for example the clamshell type packages, may also be designed just to provide physical packaging and protection without significant isolation from the outside atmosphere. The packages may further comprise venting holes or openings to allow for example excess moisture to escape from the package.

An important practical feature in such food packages is that the package allows the consumer to visually inspect the food upon purchase or before preparing for eating. This can be achieved by making the whole package transparent, or more typically, by making at least part of the lid of the package transparent. In an example, at least part of the lid of the package is transparent. For example meat is many times sold in boxes formed from thermoplastic opaque material sealed with a transparent laminated lid. Visual impression is an important part for the consumer to make his/hers purchase selection. In case of vegetables or fruits, the consumer may want to check the maturity or ripeness of the product upon purchase or later before consuming the product at home.

The need to provide visual access through the package, especially through the transparent lid, creates challenges in labelling such packages. Namely, the logical position for the label would be on the top of the package which then tends to limit the free area providing visibility into the contents of the package. Food packagers often require on their packages, decorative or informational printed labels that carry their trademark or logo, the nature of the food product in the package, and other indicia and information. Including all this indicia and information into the label, requires significant amount of area for printing, which then tends to increase the size of the label leading to limited freedom in positioning the label onto the package. The customer preference is to simultaneously see both the information on the label and the contents of the package without need to turn or tilt the package.

Different type of cardboard sleeve labels are known from the prior art as common labelling method for food packages. These are typically formed by adhering the leading and trailing ends of the cardboard sheet onto each other and then sliding such sleeve label onto the package or by forming the cardboard sleeve directly around the package. The cardboard label is held on the package based on its sleeve like form encircling the package without any direct adhesive contact to the package itself. Such labels tend to occupy large area of the circumference of the package and even if providing large area to be printed for brand and product information, they significantly or even completely obstruct the visibility into the food package contents. Cardboard sleeves also use significant amount of raw material and even as sheet like material before labelling require relatively high amount of space when stored and dispensed on the packages. They also do not provide proper means against potential counterfeiting or altering the product information because such a sleeve can be easily replaced on the food package, for example, in order to change best-before date or information indicating the origin of food products. Ever increasing labelling speeds create further challenges for cardboard sleeve labels.

Another significant deficiency in traditional cardboard sleeve labels relates to the fact that in order them being applicable to the food package, the shape of the food package needs to be fairly regular, preferably with nearly rectangular or cylindrical cross-section. In case of irregularly shaped packages where the shape may vary even between the individual packages, the sleeves are difficult to design and apply in a manner that they are reliably hold onto the package and remain also to be visually pleasing. One type of such packages are, for example, thin vacuum packed steaks where each individual package has a somewhat different shape.

Therefore, there exists a further need to provide a label arrangement for food packages allowing good visual access into the contents of the package but at the same time allowing enough space to carry brand information and other relevant information related to the food product so that the label can effectively convey to the consumer information relevant both at the retailer shelf when making purchase decision and also later at home upon nutritious consumption of the product.

This invention aims to provide a new adhesive label based solution to these problems in a manner which provides also further efficiency and economy benefits in the label laminate construction and manufacturing, label laminate converting into individual labels, label material logistics from the label converter to the end user and label dispensing at the end user onto the food packages. In addition, the invention improves the user experience of the consumer and provides high confidence that the labelled product is of true origin and the information or the contents have not been unlawfully tampered.

The invention has also other benefits explained in more detail later in this application.

SUMMARY

Aim of the invention is to provide pressure sensitive labels for consumer destined food packages.

According to an aspect of the invention there is provided a label arrangement comprising a label and a food package, which food package comprises at least an undertray and a lidstock arranged together defining in between a cavity for a food product. The label comprises a printable face material including a first surface and a second surface and pressure sensitive adhesive arranged on the second surface of the printable face material providing adhesion for attachment of the label onto the food package. The adhesion of the label towards the food package is arranged to be localized with one or more area(s) without adhesion arranged between at least two area(s) with adhesion. The printable face material is provided with one or more weakening(s) allowing to manually open at least one such weakening for folding a part of the label without adhesion away from the food package along a folding line. The folding line keeps the folded part attached to the label and rest of the label remaining attached to the food package.

According to an aspect of the invention there is provided a label arrangement for a food package. The arrangement comprises a label and a food package, which food package comprises at least an undertray and a lidstock sealed together defining in between a cavity for a food product. The label comprises at least a printable face material with first surface and second surface, pressure sensitive adhesive arranged on the second surface of the face material providing adhesion for attachment of the label onto the package. The adhesion of the label towards the food package is arranged to be localized with one or more areas without adhesion arranged in between one or more areas with adhesion. The label face material is arranged with one or more weakening allowing to manually open at least one such weakening and fold a part of the label without adhesion away from the food package along a folding line, the folding line keeping the folded part attached to the label, and the rest of label remaining attached to the package.

Another aspect of the invention includes a label where the pressure sensitive adhesive is a permanent pressure sensitive adhesive.

Another aspect of the invention includes a label where the pressure sensitive adhesive is a removable pressure sensitive adhesive for easier removal of the label from package, for example, to allow recycling of the package and/or the label materials separately.

Still another aspect of the invention comprises a label wherein the areas without adhesion are arranged by leaving said local areas without pressure sensitive adhesive. Alternatively the areas without adhesion are arranged by locally deadening the adhesion of the pressure sensitive adhesive. Areas without adhesion may be referred to as non-adhering areas.

According to an embodiment, the area(s) without adhesion are arranged by coating the pressure sensitive adhesive with non-adhesive coating.

According to one embodiment of the invention, the areas without adhesion are positioned into the areas where the label is not arranged to closely follow an outer contour of the food package, such as a vacuum food package. An area wherein the label is not arranged to closely follow the outer contour of the package is, for example, area of the label not adhered to the surface of the package.

According to an embodiment, the food package comprises an undertray bottom, tray sides and a lidstock arranged onto upper rim of the tray sides, and the label is being arranged to cover partially at least the lidstock and two of the tray sides or the lidstock, one tray side and the undertray bottom.

According to an embodiment, the food package comprises an undertray bottom, tray sides and a lidstock arranged onto upper rim of the tray sides and the label is being arranged to cover partially at least the lidstock, two of the tray sides and the undertray bottom.

According to an embodiment, the label is arranged to be wrapped around periphery of the food package in a manner that a leading edge and a trailing edge of the label touch or overlap each other at one side of the food package.

According to one embodiment of the invention, at least one of the areas without adhesion has printed information.

According to an embodiment, the label is arranged onto the food package so that a foldable part having been folded away from the food package provides visual access to the food product in the food package.

According to an embodiment, the label is arranged onto the food package so that a foldable part having been folded away from the food package allows visual access to information carried by the label.

According to an embodiment, the label is arranged on a modified atmospheric package.

According to an embodiment, the food package is a clamshell type package having a one-piece structure.

According to an embodiment, the food package is a box type package having separate lid and undertray parts.

According to an embodiment, the label is arranged to cover at most 50%, preferably at most 30%, of the lidstock.

According to an embodiment, the lidstock is transparent.

According to an embodiment, a label for a food package comprising at least an undertray and a lidstock arranged together defining in between a cavity for a food product is provided. The label comprises a printable face material including a first surface and a second surface and pressure sensitive adhesive arranged on the second surface of the printable face material for providing an adhesion area. The second surface of the printable face material comprises at least one non-adhesion area between at least two adhesion areas. The label includes a foldable part between at least one weakening and a folding line, the foldable part comprising the non-adhesion area. The at least one weakening at the foldable part is configured to enable manual opening of the weakening for folding the foldable part away from the food package along the folding line.

In the following description further embodiments of the invention and their benefits are disclosed.

DESCRIPTION OF THE DRAWINGS

Embodiments are described in more detail with the accompanying figures of which

The figures show illustrations of embodiments and those may not be in scale.

DETAILED DESCRIPTION

Figure 1A:
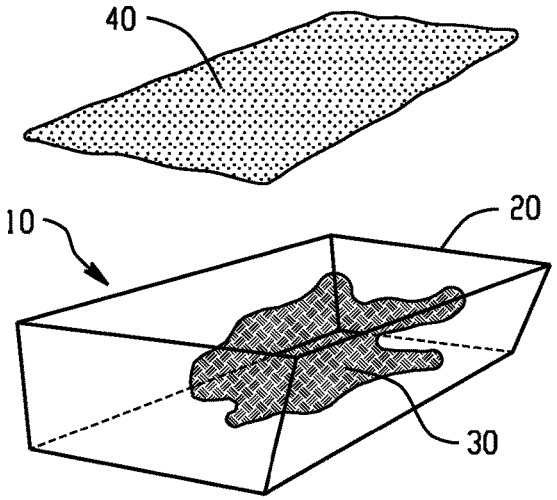
FIG. 1*a* illustrates schematically a deeper recessed hermetically sealed modified atmosphere food package with a transparent lid.

FIG. 1*a* illustrates schematically a recessed and hermetically sealed food package 10 with transparent lid. The undertray 20 carries the food 30 and the transparent lid 40 is sealed onto the undertray 20. The package may be a modified atmosphere food package where the food 30 is contained in special gaseous atmosphere preserving the freshness and preventing the decay of food. Depending on the end use, also other parts of the package 10 may be transparent and alternatively the lid 40 may be transparent only on some part of its area. In the current application a lid may also be referred to as a lidstock, or a laminated lid.

Alternatively, a food package 10 may be a so-called clamshell container. The clamshell container is a one-piece container consisting of two halves joined by a hinge area which allows the structure to come together for closing when the lid part is turned over the undertray part. This type of packages may be made of transparent plastic material and may be used for vegetables, salads or fruits. Clamshell packages may not be hermetically sealed and may even comprise additional venting holes or openings to allow excess moisture to escape from the package.

As a further alternative, a food package 10 may be a box type package consisting of separate undertray 20 and lid 40. The undertray 20 and lid 40 may be of same or different materials and they may be arranged together in an atmospherically sealed or non-sealed manner.

Figure 1B:
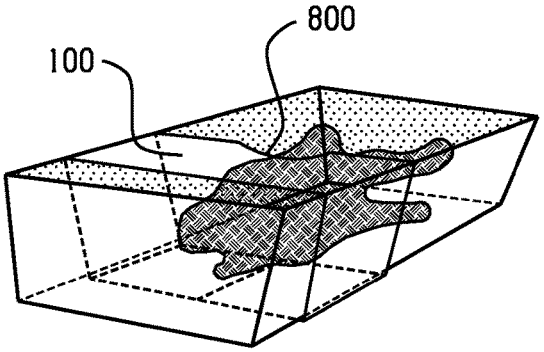
FIG. 1*b* illustrates schematically a label according to an embodiment of the invention arranged onto a food package.

FIG. 1*b* illustrates the label 100 arranged onto the food package 10. The label 100 is preferably arranged onto the package 10 in such a way that it preserves visibility into the contents of the package. This may be achieved, for example, by arranging the label closer to one end of the package 10 leaving more area of the transparent lid 40 uncovered. The label 100 may cover the circumference of the package 10 fully as a sleeve or a band. Alternatively the label 100 may cover the circumference of the package only partially covering, for example, only two or three sides of the package 10. FIG. 1*b* illustrates how label 100 extends, optionally under and/or both sides of the package 10. In an example the label 100 covers at most 50% of the lidstock. In an example the label 100 covers at most 30% of the lidstock.

The label 100 may further have one or more cut-out 800 to increase the visibility into the contents of the package 10. These cut-outs may be in the form of various intends in the label periphery or different size and shape of openings or holes through the label within the area of the label. These cut-outs may be part of the brand image presented by the label.

Figure 2A:
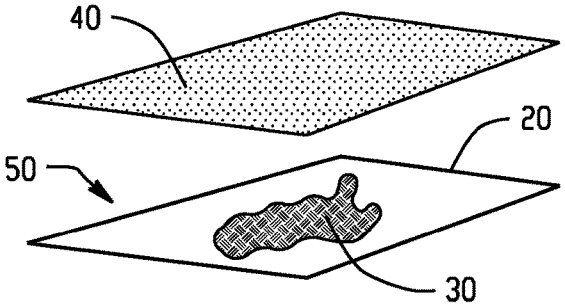
FIG. 2*a* illustrates schematically a thinner hermetically sealed food package with a transparent lid.

FIG. 2*a* illustrates a possible food package 50 format where the package is formed by laminating the undertray 20 and a lidstock 40 together to form a thin structured vacuum package for the food 30. In this case the undertray 20 or the lidstock 40 have not been preformed into any specific predefined shape and the final shape of the vacuum package is partially defined by the shape of the packaged food 30. Such packages, where the shape of the individual packages may significantly vary according to the food portion in question are, for example, vacuum packaged meat steaks, fish fillets etc.

Figure 2B:
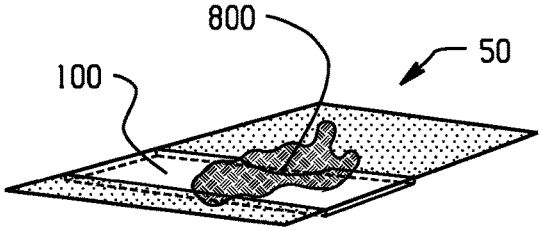
FIG. 2*b* illustrates schematically a label according to an embodiment of the invention arranged onto a food package.

FIG. 2*b* shows the label 100 arranged onto the thin vacuum package 50 previously discussed and shown in FIG. 2*a*. The label 100 according to an embodiment of the invention can be easily and reliably dispensed and attached also onto such packages as will be explained in more details later.

Figure 3A:
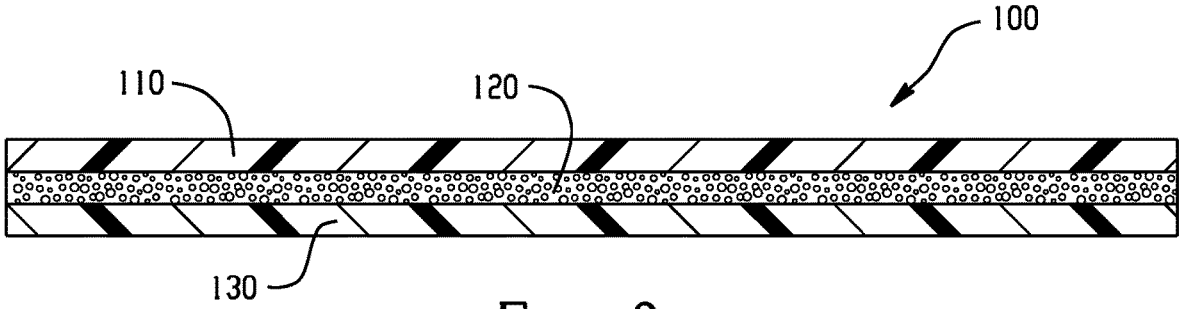
FIG. 3*a* illustrates schematically a label laminate according to an embodiment of the invention.

FIG. 3*a* shows the basic structure of the label 100 as label laminate. The face material 110 may be filmic (plastic) or paper (fiber based) material with suitable basis weight and caliper.

The face material 110 may be of a single layer construction or it may be a multilayer structure combining different materials or layers. A multilayer face material may be achieved via laminating two or more preformed layers together. In case of a filmic face material, a multilayer structure or part of it may be achieved via coextrusion.

The adhesive 120 is arranged between a release liner 130 and the face 110.

The adhesive may be, for example, hotmelt or acrylic based adhesive. The adhesive may further be adhesive that is suitable to be used in direct food contact.

The adhesive may be a permanent or removable pressure sensitive adhesive.

The adhesive may be of reclosable type allowing to open and close the label contact with the package several times. The adhesive may be a wash off adhesive designed to loose tack when exposed to water or to a specific chemical wash off process.

The release liner 130 may be filmic or paper, such as polypropylene or polyethylene terephthalate (PET) material. The release layer on the release liner may be silicone or non-silicone based material. A non-silicone based release layer may be for example fluoro based material.

At least one of the face material 110, the adhesive 120 and the release liner 130 may be fully or partially bio-based, biodegradable, compostable or combination of those. The label 100 may be designed to be easily removable from the package manually or using other suitable means to allow recycling of the package and label materials separately.

Figure 3B:
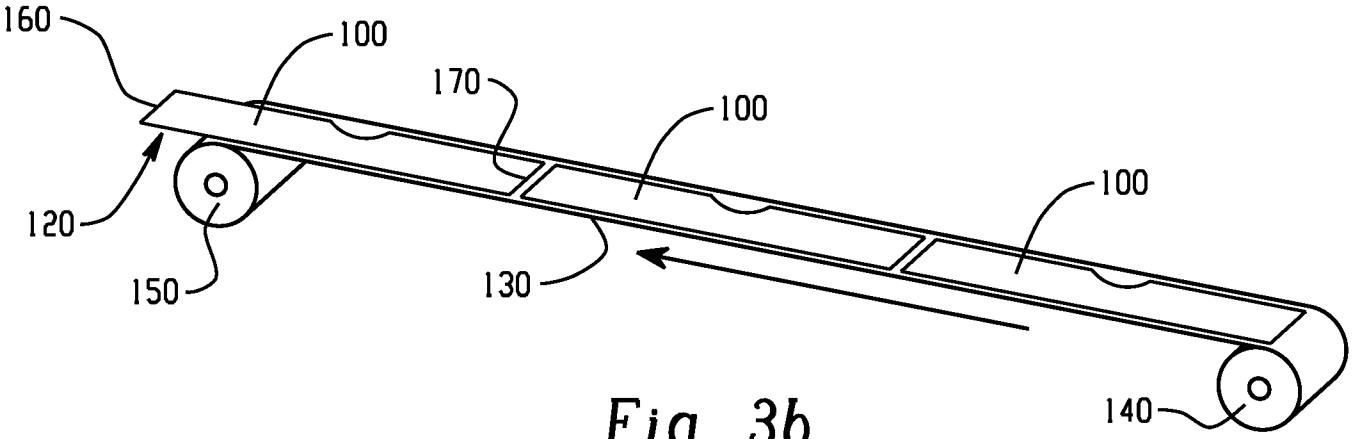
FIG. 3*b* illustrates schematically the label roll and one method of separating the lengthwise oriented labels from the release liner for dispensing.

FIG. 3*b* illustrates individual labels 100 on release liner 130 after the label laminate has been first converted by printing, perforating, die-cutting and removal of the so-called waste matrix (unused part of the face material between individual labels). In this case the labels 100 have been converted so that successive labels 100 are following each other in lengthwise arrangement on the continuous release liner web.

The aforementioned converting steps necessary to prepare the individual labels for dispensing are typically performed off-line before the dispensing phase. Depending on the equipment, some or even all of the converting steps may be also performed on-line just prior or during the dispensing. Typically, the converted label web is stored on a label roll 140 which is then reeled open during the dispensing. The individual labels are separated from the release liner 130, typically by directing the web over a so-called dispensing tip (not shown) where the label 100 becomes separated from the release liner 130 when the release liner makes a sharp turn after which the release liner 130 is reeled onto a liner roll 150 for disposal or recycling. The individual labels 100 with their pressure sensitive adhesive layer 120 then being exposed, are ready to become transferred and applied to the item to be labelled.

Figure 3C:
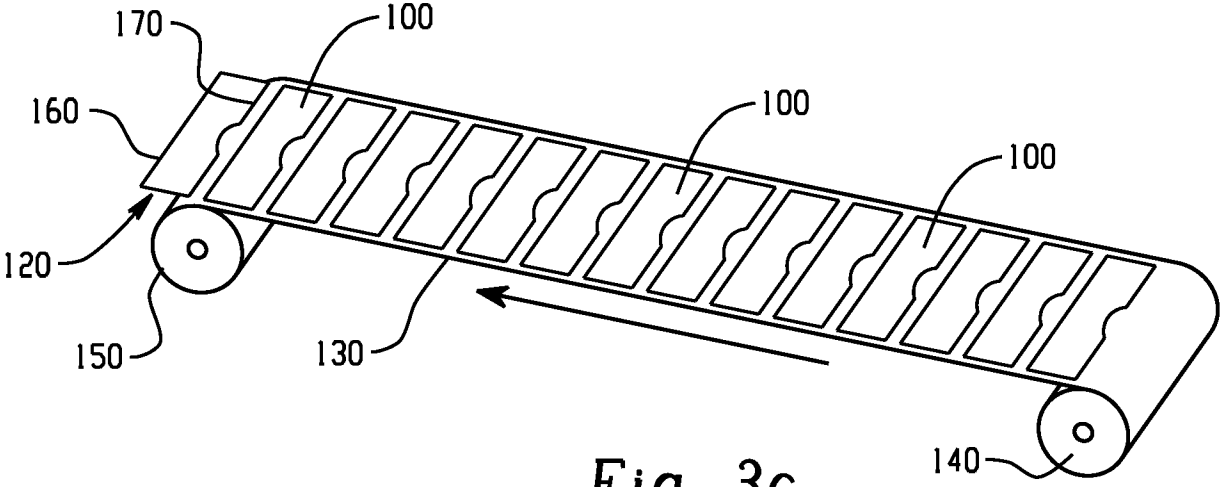
FIG. 3*c* illustrates schematically the label roll and one method of separating the widthwise oriented labels from the release liner for dispensing.

FIG. 3*c* illustrates an alternative arrangement where labels 100 have been converted so that successive labels are following each other in widthwise arrangement on the continuous release liner web 130. In this arrangement, it is beneficial that the straight edges of labels 100 are arranged to act as the leading edges 160 during dispensing. This helps successful dispensing onto the package without wrinkles or labels jamming into the dispensing machine. The trailing edges 170 of the labels 100 are arranged to carry any cut-outs or shapes deviating from straight line. In high speed dispensing, it is crucial that the dispensing of individual labels takes place without quality issues or need to stop the process for problem solving or repairs. Other ways to arrange converted and shaped labels 100 onto the release liner web 130 are also possible.

One benefit of the invention is that the label laminate according to an embodiment of the invention before or after converting steps is both flexible and thin which means that label roll 140 can carry a significantly high number of individual labels 100. This provides logistical savings and during high speed dispensing the label roll 140 does not require frequent changes compared to the work required, for example, to provide corresponding amount of cardboard sheet labels for dispensing.

FIGS. 4*a*-4*e* illustrate schematically one possible way of dispensing the pressure sensitive label 100 according to an embodiment of the invention onto a food package 10. The apparatus arranged to do this physically is not shown in FIGS. 4*a*-4*e* as the detailed structure of such apparatus is not part of this invention.

Figure 4B:
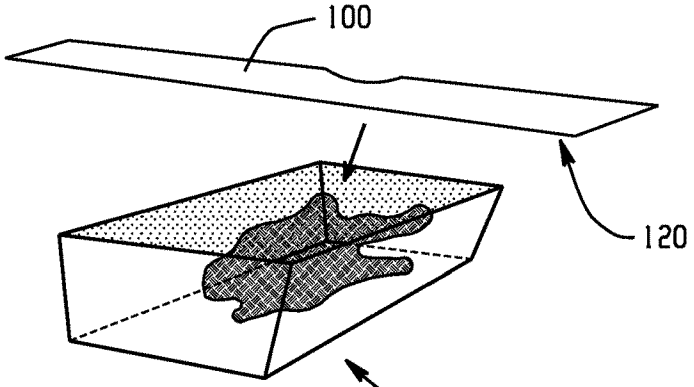
FIGS. 4*a*-4*e* illustrate schematically dispending a label according to an embodiment of the invention onto a food package.
Figure 4A:
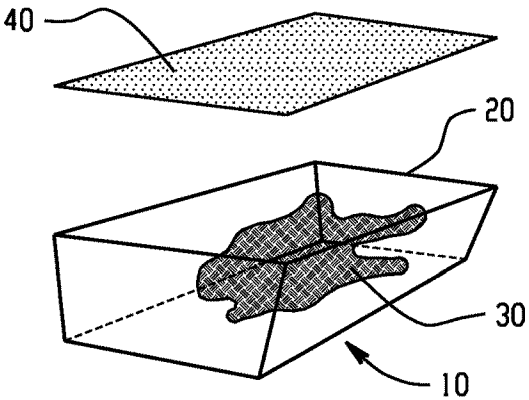
Figure 4E:
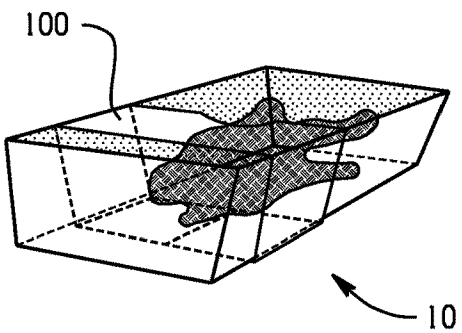
Figure 4D:
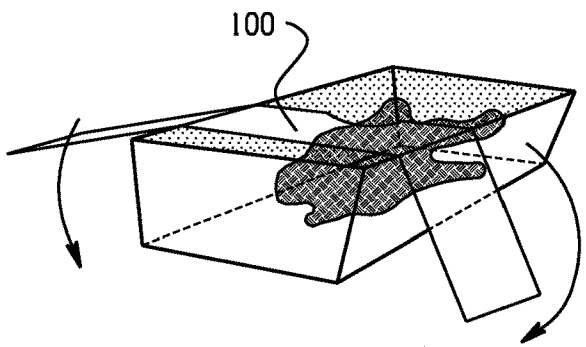
Figure 4C:
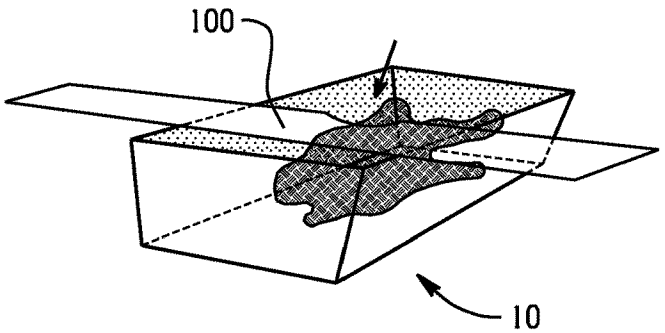
Figure 5:
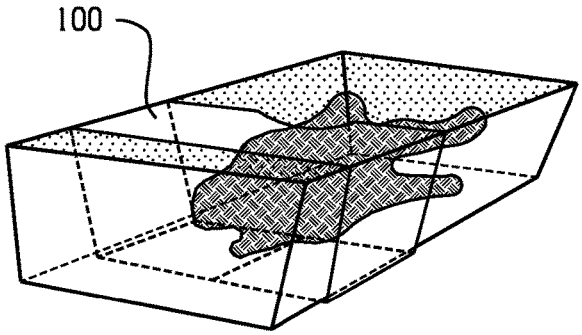
FIG. 5 illustrates a D type of label according to an embodiment of the invention on a food package.

In FIG. 4*a* the food 30 is first packaged into the undertray 20 and then the transparent lid 40 is hermetically sealed onto the undertray 20. In the same process or as separate process compared to food packing, in FIGS. 4*b* and 4*c* the label 100 with the pressure sensitive layer 120 exposed after removal of the release liner is brought into contact with the package 10 and then folded, in FIGS. 4*d* and 4*e*, around the package 10 either on two or more sides depending on the design of the label 100. By arranging the label 100, for example, closer to one end of the package 10 and the label 100 being selected for suitable width and cut-outs, a good visual access into the contents of the food package is ensured.

As an alternative, the package 10 in FIGS. 4*a*-4*e* may be replaced with a clamshell package, wherein the halves of the clamshell package can be brought together by arranging the lid part on top of the undertray part. In a typical clamshell package the lid 40 and the undertray 20 are joined by a hinge area which allows the structure to come together for closing.

As a further alternative, the package 10 in FIGS. 4*a*-4*e* may be replaced with a box type package, wherein the two separate parts of package, namely the lid 40 and the undertray 20, may be brought together by arranging the lid part on top of the undertray part.

The clamshell package and the box type package may comprise plastic material.

FIGS. 5-8 illustrate various label types according to embodiments of the invention marked as "D", "C" and "L" respectively. The difference between these types is self-evident when comparing the figures in question and noting that the main difference arises from the fact how many sides of the food package 10 the label 100 covers. Due to use of pressure sensitive adhesive, the label 100 does not need to encircle the package 10 as a complete sleeve, but may be designed to cover only necessary sides of the package. Necessary sides of the package may include at least part of the lid and in addition one or more other sides of the package. Thus, a label including pressure sensitive adhesive may cover at least part of the lid and in addition one or more other sides of the package.

Figure 9:
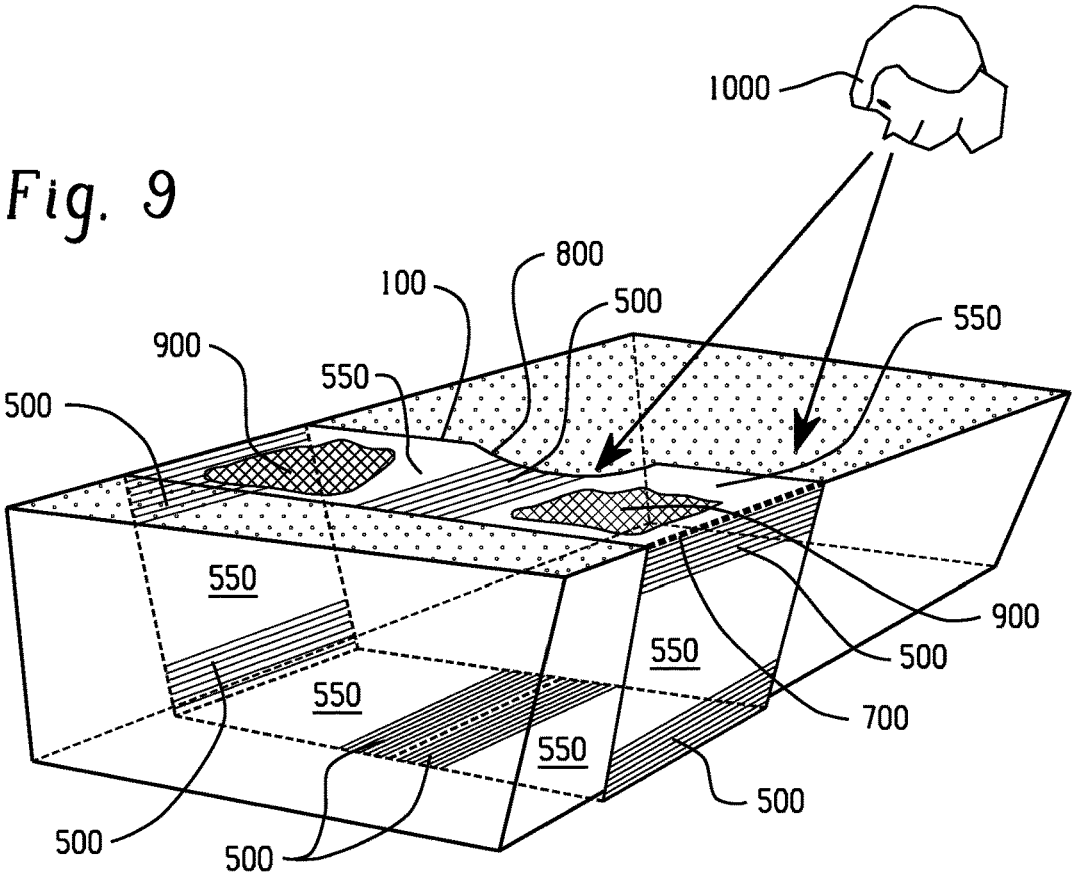
FIG. 9 illustrates schematically visual access to a food package content on a package with a label according to an embodiment of the invention.

FIG. 9 shows in more detail the structure of the label 100 according to an embodiment of the invention. In this case the label is of type "D". The consumer 1000 has visual access to the label 100 and the brand and other printed information 900 available on its upper face. The consumer 1000 has also visual access to the contents of the food package through the transparent lid 40. A cut-out 800 may be used to increase visual access to the contents of the package and/or to emphasize the brand.

In order to make the label 100 attached onto the package 10, the label has localized areas with and without adhesion. The label may comprise alternating areas with adhesion 500 and areas without adhesion 550. The attachment of the label towards the package is achieved through the areas with adhesion 500. In FIG. 9 the areas with adhesion 500 are marked with line shadings and the areas without adhesion are left between them (unmarked). Both areas 500, 550 serve a specific purpose for successful dispensing as will be shown below.

The areas with adhesion 500 are typically positioned close to the corners of the package 10 and also close to the leading edge 160 and trailing edge 170 of the label. This arrangement provides good adhesion to package on areas where the label 100 will naturally be in close contact with the package 10.

Close contact with the package refers to the area(s) of the label, which is adhered to the package through the area(s) with adhesion. In other words, the label is adhered to the surface of the package through the area(s) with adhesion. These are also the areas where the label might be most exposed to physical stress during logistics and other handling of the package 10.

The areas without adhesion 550 are arranged in between the areas of adhesion 500. However, at least on one side of the package 10, they are further arranged to allow folding the label 100 partly open. This is exemplified in FIG. 10, where the label 100 is manually opened along a weakening 700 to reveal information 950 printed on the underside of the label 100 on the area without adhesion 550. The weakening 700 may be formed, for example, as a perforation arranged on the face material 110 of the label during conversion. The folding line 750 keeps the folded part attached to the label 100 and the rest of the label 100 remains also attached to the package 10. This is important to prevent creating separated and loose litter. According to an example, alternating areas with adhesion and without adhesion together with weakenings arranged to the label face material allow manual opening and folding of the label away from the food package.

Figure 10:
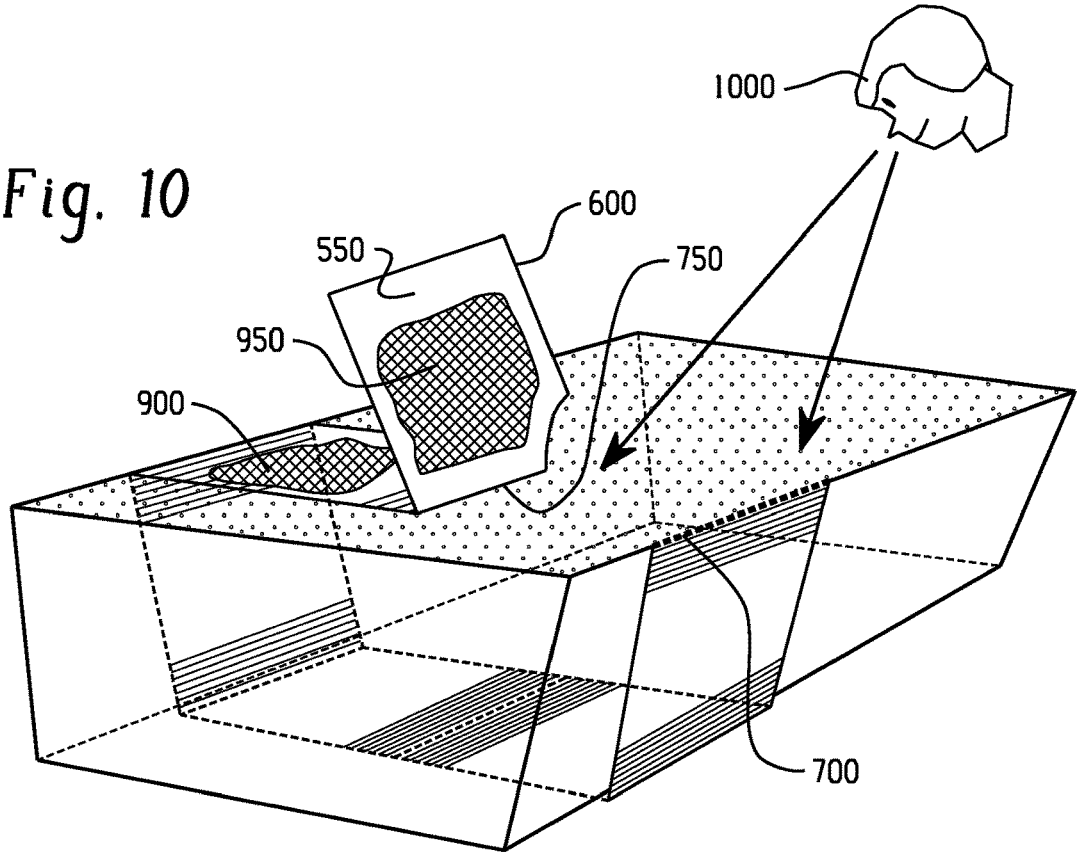
FIG. 10 illustrates schematically visual access to a food package content and a label print on a package with a label according to an embodiment of the invention.

FIG. 10 illustrates now further benefits of the label 100 according to an embodiment of the invention. The label 100 allows the consumer 1000 to inspect the contents of the package 10 before purchasing the product but at home the consumer may access further information 950 on the underside of the label and obtain even improved visual access into the package 10.

Information 950 may contain, for example, recommendations for preparing the food, information regarding the origin or nutritional value of the product, customer loyalty or award related information or any other optional or required information. Folding the label open to access the underside information does not require opening the food package 10 itself and the label 100 also remains to be attached to the package. This allows the consumer 1000, for example, to study the cooking instructions in advance and to store the product for later use without interfering the modified atmospheric or vacuum package and its internal hygiene. The additional information also remains attached to the package 10 and is not lost in the process.

One benefit of the label 100 according to an embodiment of the invention relates also to the easier removal of the label from the package 10, if such removal would be necessary, for example, to assist the separate recycling of the package 10 and the label 100 materials. The removal of the label is easier thanks to the alternating areas with adhesion 500 and without adhesion 550. Easier removal may be achieved even if the pressure sensitive adhesive 120 would be of so-called permanent adhesive which provides good adhesion to (high peeling forces from) the package.

Figure 12A:
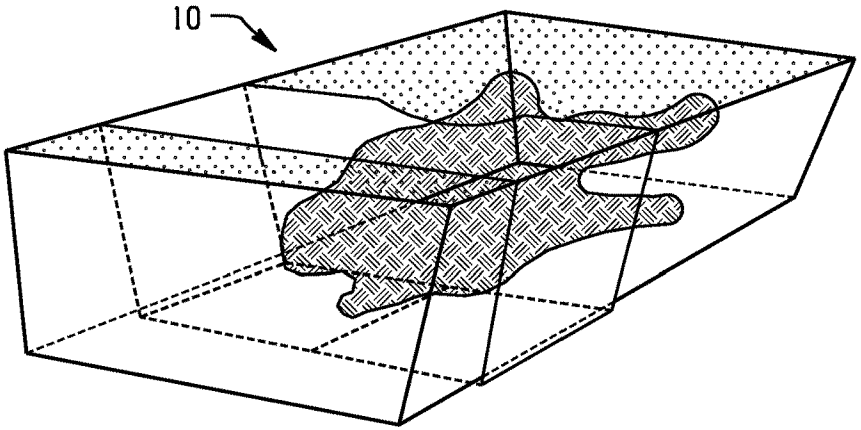
FIG. 12*a* and F12*b* illustrate schematically one further embodiment of the label according to the invention with localised areas without adhesion.
Figure 12B:
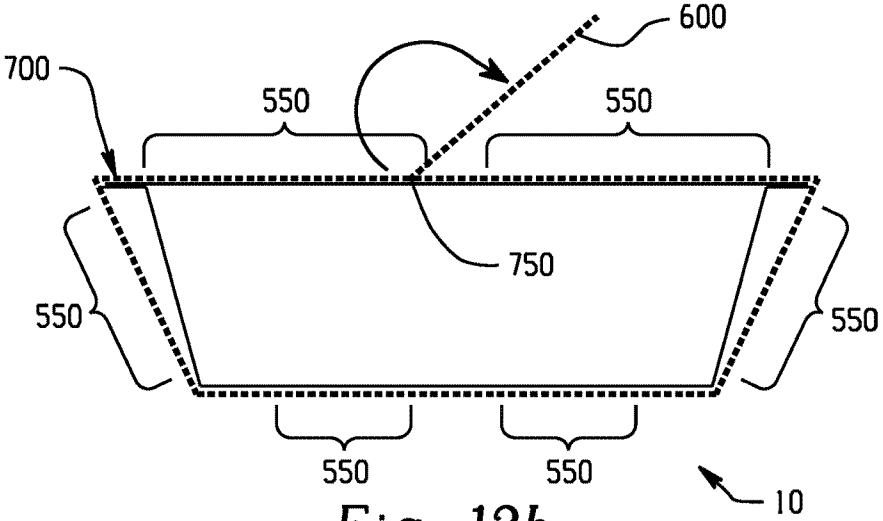
Figure 11A:
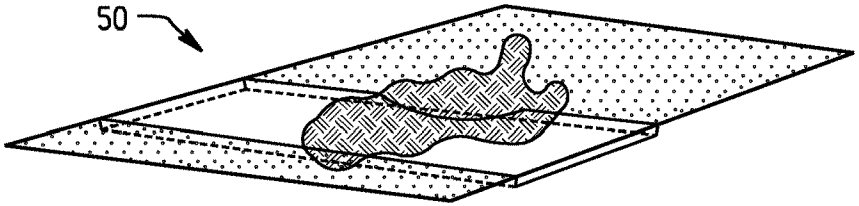
FIGS. 11*a* and F11*b* illustrate schematically one embodiment of the label according to the invention with localised areas without adhesion.
Figure 11B:
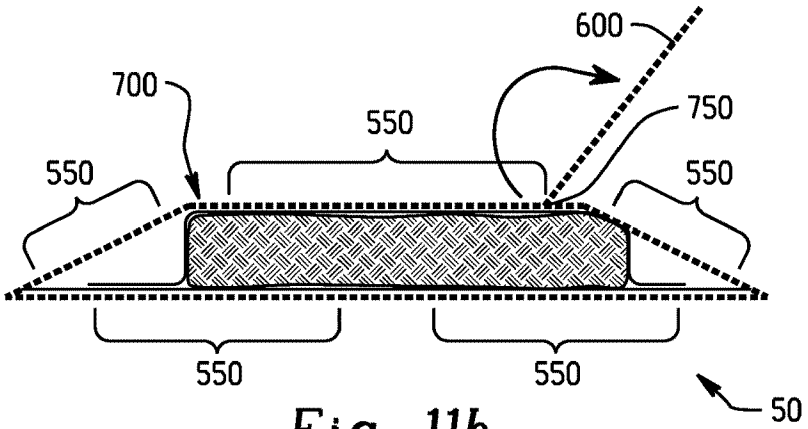

FIGS. 11*a* and 11*b* as well as FIGS. 12*a* and 12*b* illustrate in more detail the benefits of the embodiments of the invention when labelling different shape packages. In these figures the location of areas without adhesion 550 with respect to the shape of the thinner vacuum type package 50 and a deeper recessed package 10 are schematically shown. The areas with adhesion in between the areas without adhesion 550 are arranged to the edge or corner areas of the packages 10, 50 where the label is in good contact with surface of the package. In case of vacuum type packages 50, the shape of the package may significantly vary from individual package to another and the role of correct positioning of the areas without adhesion 550 play an important role that these packages can be labeled so that the visual appearance of the labels are maintained without wrinkles etc. even on the areas where the label is not touching the surface of the package. The dispensing of the label onto an irregularly shaped package 50 also requires that when rolling or folding the label onto the package with aid of rolls or brushes or air jets, the label has adhesion on correct locations so that wrinkles can be avoided. The optimal location of the areas with and without adhesion respectively depend on the size and shape of the package and may be adjusted during the design of the label 100. As a general rule, the adhesion providing areas are to be positioned into areas where the label is in good contact with package, for example close to the edges/corners of the package. Good contact may also be referred to as direct or solid contact, wherein the adhesive is directly attaching the surface of the package. Respectively, the areas without adhesion can be arranged in areas where the label does not naturally touch the package due to the shape of the package, for example in case of vacuum packed food.

Figure 6:
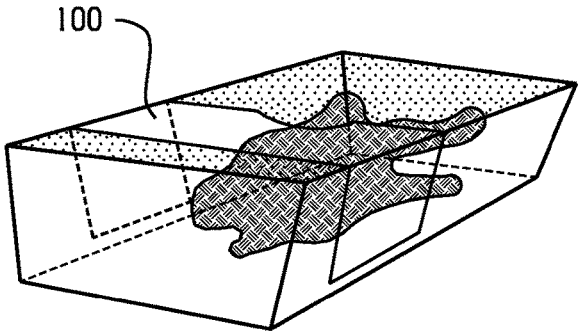
FIG. 6 illustrates a C type of label according to an embodiment of the invention on a food package.
Figure 7:
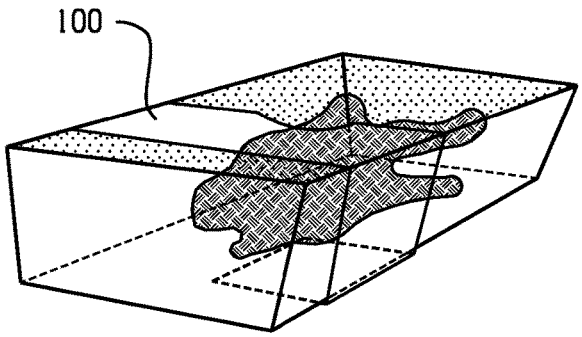
FIG. 7 illustrates an alternative C type of label according to an embodiment of the invention on a food package.
Figure 8:
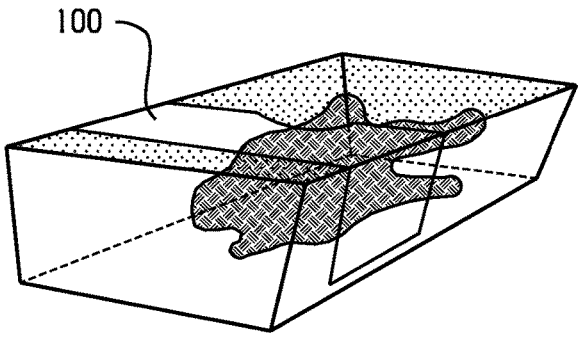
FIG. 8 illustrates an L type of label according to an embodiment of the invention on a food package.
Figure 13:
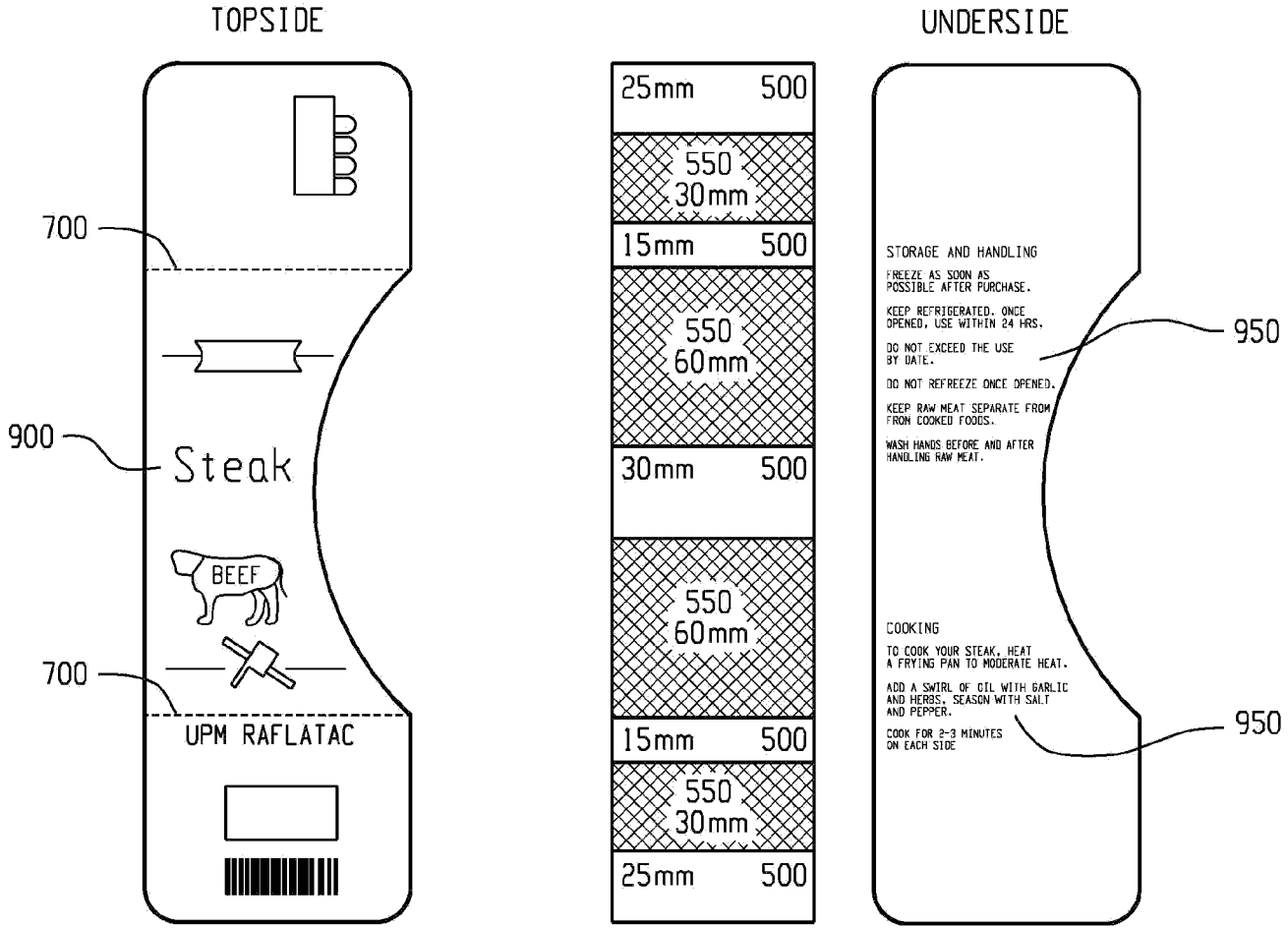
FIG. 13 illustrates a printed label according to one embodiment of invention.

FIG. 13 presents one example of the label 100 according to an embodiment of the invention corresponding type "C" as indicated in FIG. 6. The left hand side of FIG. 12 shows the label 100 as seen from the topside. A moderate cut-out 800 is arranged in the middle of the label. Perforations as weakenings 700 are indicated as dash lines. Brand and other printed information 900 are provided on the label topside. The right hand side of FIG. 13 shows the label 100 as seen from the underside with further information 950 available to the customer after folding the label open. The middle part of FIG. 13 indicates the areas without adhesion 550 with darker color as well as the areas with adhesion 500 on lighter color. In each of these areas their respective width is also indicated in millimeters. The areas with and without adhesion alternate along longitudinal direction of the label, as illustrated in FIG. 13. In cross direction the areas with and without adhesion may correspond to the size of the label.

As indicated in FIG. 13, the further information 950 has been provided in the areas without adhesion 550 allowing the customer to fold that part open away from the package. Due to the non-stickiness of that part of the label, this procedure is convenient for the customer to perform. Preferably, the topside of the label 100 has an indication to the customer that further information is available when folding a foldable part 600 of the label away from the package 10.

The labels 100 according to one or more embodiments of the invention may have multicolor printing on the topside applied, for example, using flexo printing or any other printing method that a person skilled in the art would consider suitable for this purpose. The printing of the information 950 on the underside may be performed on the adhesive, after which the adhesion is killed in that area 550 using lacquer, varnish or other suitable method. Alternatively, the printing of the information 950 on the underside may be performed after the non-adhesion areas 550 have been formed either using aforementioned adhesion killing methods or pattern gumming. In pattern gumming the adhesive is originally applied only locally therefore no adhesion killing is necessary later.

Typically, during the label laminate manufacturing the adhesive is coated evenly to cover the total area of the release liner 130. This adhesive layer is then cured with heat to become pressure sensitive adhesive 120. The pressure sensitive laminate is then formed by laminating the pressure sensitive adhesive coated release liner 130 with the face material 110. This laminate is then converted into printed and die-cut labels. The laminate may be opened during these converting phases to perform the underside printing and adhesion killing and these and other manufacturing or converting steps may be performed in any order suitable and practical for that particular case.

As discussed above, the non-adhering areas can be formed locally by killing the adhesion of selected areas of the adhesive after the laminate has already been originally formed. Alternatively, it is also possible to use so-called pattern gumming where the adhesive is coated only onto the necessary areas of the release liner before the lamination phase and original lamination forming.

Adhesion killing and pattern gumming can also be used in combination to achieve the necessary outcome.

"Pressure sensitive adhesive" (PSA) herein refers generally to an adhesive that bonds firmly with the application of light pressure. It adheres to most surfaces with very slight pressure; is available in solvent, latex or water based forms, and is often based on non-crosslinked rubber adhesives, acrylics, or polyurethanes. PSA forms viscoelastic bonds that are aggressively and permanently tacky; adhere without the need for more than hand pressure; and require no activation by water, solvent, or heat. Some PSA materials are cured by hot air, electron beam, UV, or chemical.

Permanent type pressure sensitive adhesive refers to PSA, which has high permanent bondage to the labelled surface. This means that the adhesive is not intended to become easily released and then reapplied. It does not mean that the label cannot be manually separated from the labelled item but that this cannot happen unintentionally.

Removable type pressure sensitive adhesive refers to PSA, which has lower permanent bondage to the labelled surface. This means that the adhesive is intended to become easily manually released.

Reclosable or open-closure type pressure sensitive adhesive refers to PSA, which has lower permanent bondage to the labelled surface. This means that the adhesive is intended to become easily manually released and can also be reapplied manually onto the surface several times.

A face material 110 of the label 100 may be a filmic (plastic) or paper based or a combination of these. The face material may be a single layer or a multilayer structure.

A paper based face material may comprise glassine or kraft paper, for example. The plastic film may comprise polymers, such as polyolefin, polyester, polystyrene, polyurethane, polyamide, polyvinylchloride or any combinations of these. The face material may be biodegradable, such as lactic acid, starch or cellulose based. The polymer film may include homopolymers, copolymers or it may consists of a polymer blend. For example, the face material may comprise mixtures of polyolefins, such as polyethylene (PE) and polypropylene (PP). In addition, the plastic film may comprise additives, such as pigments or inorganic fillers to provide, for example, a desired colour for the face. Additives may include, for example, titanium dioxide, calcium carbonate and blends thereof. The plastic film may comprise minor amounts of other additives and/or film modifiers, e.g. plasticisers, stabilizers, anti-static agents, slip/anti-block agents.

The face material 110 may be coated for improving its visual appearance, physical properties or printability. The face material 110 may comprise barrier properties.

The face material 110 comprises two surface sides. One of the surface sides of the face material, a backside, is able to receive adhesive. The face material is compatible with adhesive. Anchorage between the face and adhesive is desired. Adhesive migration on the face surface is not desired. The face material and adhesive shall have no harmful reaction(s) between the two.

Another face material side, a front side, opposing the side arranged to receive adhesive, is printable. Properties of the face material have effect on printing and/or print quality, for example on density levels of ink/toner, bleeding of ink/toner, ink/toner transfer and anchorage. The paper face absorption properties, surface properties, surface chemistry, surface porosity may have effect on printing and print quality. The surface suitable for printing has a sufficiently high surface tension. A low surface tension may lead to poor retaining capability of printing ink/toner applied to the surface. For example, the plastic film may have a surface tension at least 36 dynes/cm, preferably at least 38 dynes/cm or at least 44 dynes/cm measured according to the standard ASTM D-2578. The surface tension may be between 36 and 60 dynes/cm, preferably between 38 and 56 dynes/cm or between 44 and 50 dynes/cm.

The face material may be printable via thermal printing, for example via direct thermal printing. The face material is suitable for thermal printing and thermal print transfer. The face material may comprise a thermal coating at both sides or least on one side for receiving a print. The face material smoothness has effect on providing suitable and even contact between print ink and the face material. The face material absorption properties have effect on anchorage of the ink.

The release liner 130 may comprise a paper or a plastic film, for example polyethylene, polypropylene or polyester. The liner may be comprise polyethylene terephthalate (PET). A liner comprising a plastic film has effect on smoothness of the surface. For example, an uncoated paper liner may comprise less smoothness on the surface compared to a plastic film liner. Smooth surface of a plastic liner may have effect on clarity of a transparent liner. A transparent liner enables providing a print on both liner surface, or on both face material surfaces. A transparent liner may enable providing a visible print on a face surface or on a liner surface arranged next to each other, or on an adhesive. A plastic liner comprises good mechanical properties having positive effect on strength. This provides strength and wear sustainability for the label, since the liner is not removed, but left between attached ends of the label. A liner protects adhesive layer during shipment and storage. A liner enables a label web to be rolled on a roll.

For fluent and reliable handling and dispensing the materials for the label 100 need to be selected accordingly. Below certain parameters for the materials are given with suitable ranges. As shown, the optimal ranges may vary in machine direction (MD) and transverse direction (TD) of the label laminate web. TD refers to a cross (machine) direction (CD).

Parameters for Paper Face Materials

In General stiffness in MD 0.08-1.2 mNm according to ISO/DP 2493 stiffness in CD 0.04-1.1 mNm according to ISO/DP 2493 tear strength in MD 250-1100 mN according to ISO 1974 tear strength in CD 250-1200 mN according to ISO 1974

For Higher Speed Labelling and/or Challenging Package and/or Label Shapes stiffness in MD 0.2-0.85 mNm according to ISO/DP 2493 stiffness in CD 0.1-0.70 mNm according to ISO/DP 2493 tear strength in MD 300-950 mN according to ISO 1974 tear strength in CD 300-1100 mN according to ISO 1974

Depending on the Application caliper range 40-350 microns according to ISO 534 or for thinner label applications caliper range 60-130 microns according to ISO 534

Parameters for Filmic Face Materials caliper range 15-200 microns ISO 534 or for thinner label applications caliper range 35-100 microns ISO 534

Food Approval for Filmic Faces

EU 10/2011 on plastic materials and articles intended to come into contact with food, EC 1935/2004 on materials and articles intended to come into contact with food, the German recommendation BfR (Bundesinstitut für Risikobewertung) BfR XIV for plastic dispersion, FDA (Food and Drug Code of Federal Regulations),

FDA 21 CFR

Parameters for Permanent Pressure Sensitive Adhesive peel on PE min. 3 N after 24 hrs-max. 30 N after 20 minutes according acc. modified test method FTM 2 (substrate surface polyethylene)

According to an embodiment, a label arrangement comprising a label 100 and a food package 10,50 is provided. The food package comprises at least an undertray 20 and a lidstock 40 sealed together defining in between a cavity for a food product 30. The label comprises at least a printable face material 110 with first surface and second surface and pressure sensitive adhesive 120 arranged on the second surface of the face material providing adhesion for attachment of the label onto the package. The adhesion of the label 100 towards the food package 10, 50 is arranged to be localized with one or more areas without adhesion 550 arranged in between one or more areas with adhesion 500. The label face material is arranged with one or more weakenings 700 allowing to manually open at least one such weakening and fold a part of the label without adhesion away from the food package along a folding line 750, the folding line keeping the folded part attached to the label, and the rest of label remaining attached to the package.

According to an embodiment, the pressure sensitive adhesive 120 is a permanent pressure sensitive adhesive.

According to an embodiment, the areas without adhesion 550 are arranged by leaving said areas without pressure sensitive adhesive 120.

According to an embodiment, the areas without adhesion 550 are arranged by deadening the adhesion of the pressure sensitive adhesive 120.

According to an embodiment, the areas without adhesion 550 are arranged by coating the pressure sensitive adhesive 120 with non-adhesive coating.

According to an embodiment, the areas without adhesion 550 are positioned into the areas where the label is not to closely follow the outer contour of the food package 10,50.

According to an embodiment, the package is a vacuum food package.

According to an embodiment, the food package 10 comprises an undertray bottom, tray sides and a lidstock 40 sealed onto the upper rim of the tray sides and the label is arranged to cover partially at least the lidstock and one or more of the tray sides or tray bottom in C-shape.

According to an embodiment, the food package 10 comprises an undertray bottom, tray sides and a lidstock 40 sealed onto the upper rim of the tray sides and the label is arranged to cover partially at least the lidstock, two of the tray sides and the tray bottom in D-shape.

According to an embodiment, the label 100 is arranged to be wrapped around periphery of the package in a manner that a leading end 160 and a trailing end 170 of the label touch or overlap each other at one side of the package.

According to an embodiment, the areas without adhesion 550 are positioned into the areas where the label is not to closely follow the outer contour of the food package 10,50.

According to an embodiment, at least one of the areas without adhesion 550 has been printed 900.

According to an embodiment, the label 100 is arranged on the package 10,50 so that the folded part 600 having been folded away from the package increases visual access to food product 30 in the package 10, 50.

According to an embodiment, the label 100 is arranged on the package so that the folded part 600 having been folded away from the package allows visual access to the printed information 950 carried by the label 100.

According to an embodiment, the label is arranged on a modified atmospheric package (MAP).

The invention claimed is:

1. A label arrangement comprising an adhesive label (100) and a food package (10, 50), which food package comprises at least an undertray (20) and a lidstock (40) sealed together defining in between a cavity for a food product (30), the adhesive label (100) comprising a printable face material (110) including a first surface and a second surface, pressure sensitive adhesive (120) arranged on the second surface of the printable face material providing adhesion for attachment of the adhesive label (100) onto the food package (10, 50), characterized in that the adhesion of the adhesive label (100) towards the food package (10, 50) is arranged to be localized with one or more area(s) without adhesion (550) arranged between at least two area(s) with adhesion (500), the printable face material (110) is provided with one or more weakening(s) (700) allowing to manually open at least one such weakening (700) for folding the area without adhesion away from the food package (10, 50) along a folding line (750), the folding line (750) keeping the folded part attached to the adhesive label (100), an area with adhesion is arranged next to the following line, and the pressure sensitive adhesive maintains adhesion of the rest of the adhesive label (100) to the food package (10, 50) when the area without adhesion (550) is folded away from the food package (10,50);

wherein the area(s) without adhesion (550) are positioned into area(s) where the adhesive label (100) is not arranged to closely follow an outer contour of the food package (10, 50); wherein the adhesive label is automatically dispensed by a dispensing apparatus from a release liner to the food package in a single dispensing step by folding the adhesive label around the food package on at least two sides of the food package; and wherein the label is quadrangular.

2. The label arrangement according to claim 1, wherein the pressure sensitive adhesive (120) is a permanent pressure sensitive adhesive.

3. The label arrangement, according to claim 1, wherein the pressure sensitive adhesive (120) is a removable pressure sensitive adhesive.

4. The label arrangement according to claim 1, wherein the area(s) without adhesion (550) are arranged by leaving said area(s) without pressure sensitive adhesive (120).

5. The label arrangement according to claim 1, wherein the area(s) without adhesion (550) are arranged by deadening the adhesion of the pressure sensitive adhesive (120).

6. The label arrangement according to claim 1, wherein the area(s) without adhesion (550) are arranged by coating the pressure sensitive adhesive (120) with non-adhesive coating.

7. The label arrangement according to claim 1, wherein the food package (10, 50) is a vacuum food package.

8. The label arrangement according to claim 1, wherein the food package (10) comprises an undertray bottom, tray sides and a lidstock (40) arranged onto upper rim of the tray sides and the adhesive label (100) is being arranged to cover partially at least the lidstock (40) and two tray sides or the lidstock (40), one tray side and the undertray bottom.

9. The label arrangement according to claim 1, wherein the food package (10) comprises an undertray bottom, tray sides and a lidstock (40) arranged onto upper rim of the tray sides and the adhesive label (100) is being arranged to cover partially at least the lidstock (40), two of the tray sides and the undertray bottom.

10. The label arrangement according to claim 1, wherein the adhesive label (100) is arranged to be wrapped around periphery of the food package (10, 50) in a manner that a leading edge (160) and a trailing edge (170) of the adhesive label (100) touch or overlap each other at one side of the food package.

11. The label arrangement according to claim 1, wherein at least one of the areas without adhesion (550) has printed information (950).

12. The label arrangement according to claim 1, wherein the adhesive label (100) is arranged on the food package (10,50) so that a foldable part (600) having been folded away from the food package provides visual access to the food product (30) in the food package (10, 50).

13. The label arrangement according to claim 1, wherein the adhesive label (100) is arranged onto the food package so that a foldable part (600) having been folded away from the food package allows visual access to information (950) carried by the adhesive label (100).

14. The label arrangement according to claim 1, wherein the adhesive label (100) is arranged on a modified atmospheric package (MAP).

15. The label arrangement according to claim 1, wherein the food package (10) is a clamshell type package having a one-piece structure.

16. The label arrangement according to claim 1, wherein the food package (10) is a box type package having separate lid and undertray parts.

17. The label arrangement according to claim 1, wherein the adhesive label (100) is arranged to cover at most 50%, of the lidstock (40).

18. The label arrangement according to claim 1, wherein the lidstock (40) is transparent.

19. The adhesive label of claim 1, wherein one side of the quadrangular label deviates from a straight line.

20. The adhesive label of claim 1, wherein the label is rectangular, optionally wherein one side of the rectangular label deviates from a straight line.

21. An adhesive label (100) for a food package (10, 50), the food package (10, 50) comprising at least an undertray (20) and a lidstock (40) sealed together defining in between a cavity for a food product (30), wherein the adhesive label (100) comprises a printable face material (110) including a first surface and a second surface, pressure sensitive adhesive (120) arranged on the second surface of the printable face material for providing an adhesion area, characterized in that the second surface of the printable face material comprises at least one non-adhesion area (550) between at least two adhesion areas (500), the adhesive label (100) includes a foldable part (600) between at least one weakening (700) and a folding line (750), the foldable part (600) comprising the non-adhesion area (550), an area with adhesion is arranged next to the folding line, and the at least one weakening (700) at the foldable part (600) is configured to enable manual opening of the weakening (700) for folding the foldable part (600) away from the food package (10, 50) along the folding line (750);

wherein the at least one non-adhesion area (550) is positioned in such a way, that the adhesive label (100) is arrangeable not to closely follow an outer contour of the food package (10, 50);

wherein the pressure sensitive adhesive maintains adhesion of the adhesion area of the adhesive label (100) to the food package (10, 50) when the non-adhesion area (550) is folded away from the food package (10,50);

wherein the adhesive label is automatically dispensed by a dispensing apparatus from a release liner to the food package in a single dispensing step by folding the adhesive label around the food package on at least two sides of the food package; and wherein the label is quadrangular.

22. The adhesive label (100) according to claim 21, wherein the pressure sensitive adhesive (120) is a permanent pressure sensitive adhesive.

23. The adhesive label (100) according to claim 21, wherein the at least one non-adhesion area (550) is arranged by leaving said area without pressure sensitive adhesive (120).

24. The adhesive label (100) according to claim 21, wherein the at least one non-adhesion area (550) is arranged by deadening adhesion of the pressure sensitive adhesive (120).

25. The adhesive label (100) according to claim 21, wherein the at least one non-adhesion area (550) is arranged by coating the pressure sensitive adhesive (120) with non-adhesive coating.

26. The adhesive label (100) according to claim 21, wherein the adhesive label (100) is arrangeable to cover partially at least the lidstock (40) and two further sides of the food package (10).

27. The adhesive label (100) according to claim 21, wherein the adhesive label (100) is arrangeable to cover partially at least the lidstock (40), the undertray (20) and optionally tray sides connecting the lidstock (40) and the undertray (20).

28. The adhesive label (100) according to claim 21, wherein the adhesive label (100) is arrangeable to be wrapped around periphery of the food package (10) in such a way that a leading edge (160) and a trailing edge (170) of the adhesive label (100) touch or overlap each other at one side of the food package.

29. The adhesive label (100) according to claim 21, wherein the at least one non-adhesion area (550) has printed information (950).

30. The adhesive label (100) according to claim 21, wherein the foldable part (600) of the label is configured to be foldable away from the adhesion area (500) of the adhesive label in order to provide visual access to the cavity in the food package (10, 50).

31. The adhesive label (100) according to claim 21, wherein the foldable part (600) of the label is configured to provide visual access to information (950) carried by the second surface of the printable face material.

32. The adhesive label (100) according to claim 21, wherein the adhesive label (100) comprises a width and a length, wherein the length is greater than the width; and alternating non-adhesion areas and adhesion areas are provided along length of the adhesive label.

33. The adhesive label (100) according to claim 21, wherein the weakening (700) comprises a perforation.

* * * * *